United States Patent [19]

Grayston

[11] 4,015,371

[45] Apr. 5, 1977

[54] GRINDING WHEEL ASSEMBLY

[75] Inventor: Judson M. Grayston, Joplin, Mo.

[73] Assignee: Machinery Brokers, Inc., Springfield, Mo.

[22] Filed: Apr. 8, 1976

[21] Appl. No.: 674,926

[52] U.S. Cl. ..... 51/168; 51/209 R

[51] Int. Cl.[2] ..... B24B 41/04; B24D 5/16

[58] Field of Search ..... 51/168, 169, 206 R, 51/209 R, 209 DL, 209 S, 376–379

[56] References Cited

UNITED STATES PATENTS

| | | | |
|---|---|---|---|
| 2,567,782 | 9/1951 | Rhees | 51/376 |
| 3,081,584 | 3/1963 | Bullard | 51/209 R |
| 3,136,100 | 6/1964 | Robertson | 51/209 R |
| 3,210,892 | 10/1965 | Perham | 51/209 R X |
| 3,879,178 | 4/1975 | Bosma | 51/168 |

FOREIGN PATENTS OR APPLICATIONS

| | | |
|---|---|---|
| 1,451,937 | 9/1966 | France |

*Primary Examiner*—Gary L. Smith
*Attorney, Agent, or Firm*—Cushman, Darby & Cushman

[57] ABSTRACT

A grinding wheel assembly having a throw-away type hub construction in which the insert member imbedded in the molded abrasive disk hub portion is provided with a plurality of circumferentially spaced grooves in the juncture between the cylindrical section and annular flange section thereof. The die cast metallic shaft engaging member is provided with mating tongues or projections shaped to engage axially within the grooves when the extremity of the cylindrical portion of the die cast member is swaged into engagement with the adjacent face of the hub portion when in assembled relation therewith.

10 Claims, 5 Drawing Figures

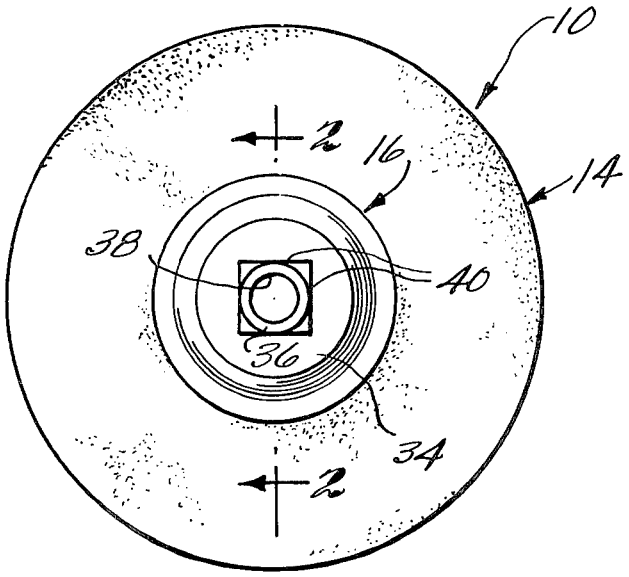
Fig. 1.
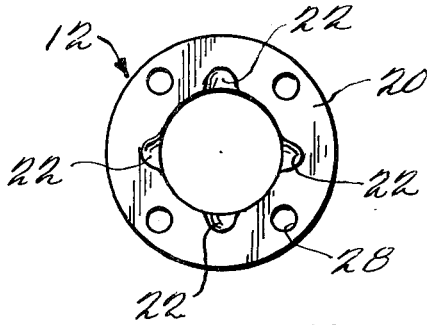
Fig. 4.
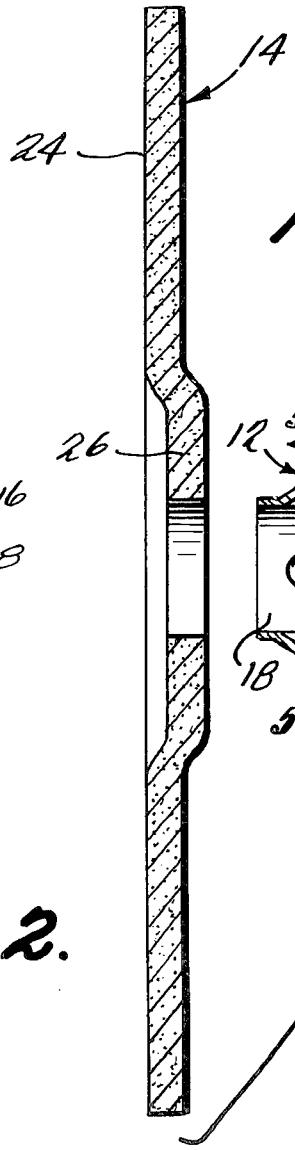
Fig. 3.
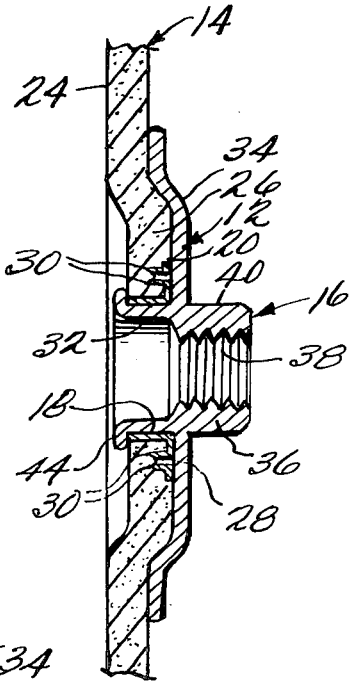
Fig. 2.
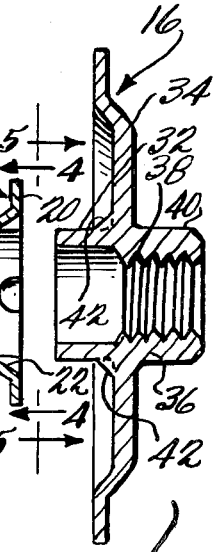
Fig. 5.
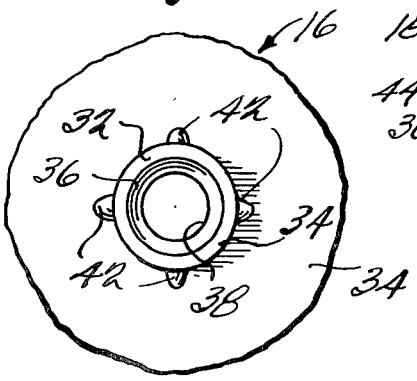

GRINDING WHEEL ASSEMBLY

This invention relates to the connection of rotatably driven members with driving shafts and more particularly to an improved grinding wheel assembly for connection with a driving shaft end.

The use of rotatably driven grinding or abrasive wheels is widespread and well known. Also well known are the problems incident to the connection of such wheels to the shaft which is utilized to drive them. It is now accepted practice in many instances to provide such wheels with an inexpensive integrally assembled hub construction configured to facilitate the attachment of the grinding wheel to the shaft end. In many instances, such grinding wheels with integral "throw-away" hub constructions are considered to be more efficient than the utilization of grinding wheels of the type requiring the utilization therewith of re-usable arbor parts for effecting the connection of the grinding wheel with the shaft. Basically, the throw-away assemblies are considered sufficiently advantageous from the standpoint that the time required to effectively replace a worn-out grinding wheel with a new grinding wheel is considerably reduced. Thus, grinding wheel assemblies with throw-away hub constructions are greatly preferred in situations where grinding wheels must be relatively frequently replaced.

Since grinding wheels assembled with throw-away hub constructions provide for a relatively quick and effective threaded connection with the shaft (but see U.S. Pat. No. 3,210,892), connection failure between the shaft and abrasive wheel has occurred in this type of assembly between the member of the assembly which connects to the shaft and the abrasive disk itself. In order to minimize such failures in operation, it has been proposed to provide an adhesive interconnection between the shaft engaging member and the abrasive wheel, see, for example, U.S. Pat. No. 3,081,584 and 3,136,100. While the utilization of adhesives has served to increase the strength of the connection between the abrasive disk and the shaft connecting member as compared with prior art connections of the type without such adhesive, the utilization of adhesives adds expense to the assembly both in terms of added material and assembly costs. Moreover, such adhesives have not proven to be entirely effective.

Accordingly, it is an object of the present invention to provide a grinding wheel assembly having a throw-away type hub construction having improved means for preventing failure of the connection between the shaft engaging member and the abrasive disk of the assembly which overcomes the disadvantages noted above. In accordance with the principles of the present invention, this objective is obtained by providing a plurality of annularly spaced grooves in the sheet metal insert member of the assembly in the juncture between the cylindrical section and annular flange section thereof. With such grooves provided in the sheet metal insert member which is molded with the abrasive disk so as to be imbedded in the hub portion thereof, the cast metallic member of the assembly is provided with mating projections or tongues. When these members are assembled the shaft engaging member is effectively keyed to the abrasive disk by intermating tongue and grooves formed in metallic members of the assembly. Consequently, the chances of failure by a relative turning movement between the shaft engaging member and the abrasive wheel are reduced to a minimum without the necessity of providing additional material in the form of an adhesive or additional operative steps in the assembly of the component parts of the grinding wheel assembly.

Another object of the present invention is the provision of a grinding wheel assembly of the type described which is simple in construction, effective in operation and economical to manufacture.

These and other objects of the present invention will become more apparent during the course of the following detailed description and appended claims.

The invention may best be understood with reference to the accompanying drawings wherein an illustrative embodiment is shown.

In the drawings:

FIG. 1 is a rear elevational view of a grinding wheel assembly embodying the principles of the present invention;

FIG. 2 is an enlarged fragmentary sectional view taken along the line 2—2 of FIG. 1;

FIG. 3 is a vertical sectional view of the basic component parts of the grinding wheel assembly in exploded relation;

FIG. 4 is an elevational view taken along the line 4—4 of FIG. 3; and

FIG. 5 is a fragmentary sectional view taken along the line 5—5 of FIG. 3.

Referring now more particularly to the drawings, there is shown in FIG. 1 thereof a grinding wheel assembly, generally indicated at 10, embodying the principles of the present invention. As shown in FIG. 1 and in the exploded view illustrated in FIG. 4, the grinding wheel assembly 10 consists essentially of three component parts: a sheet metal insert member, generally indicated at 12; an abrasive wheel member, generally indicated at 14, formed by molding with the sheet metal member 12 imbedded therein; and a die cast metallic shaft engaging member, generally indicated at 16.

The sheet metal insert member 12 is preferably stamped from thin gauge metal so that it provides a thin walled structure which includes a cylindrical section 18 and an annular flange section 20 extending radially outwardly from one end of the cylindrical section 18. Formed in the juncture between the cylindrical section 18 and the annular flange section 20 is groove means in the form of a plurality of circumferentially spaced grooves 22. As best shown in FIGS. 3 and 4, each groove 22 is essentially triangular in configuration and opens in an axial direction opposed to the direction of extent of the cylindrical section 18 from the annular section 20.

The abrasive wheel member 14 is formed of a molded material having suitable abrasive particles imbedded therein so as to present at least one operative abrasive surface, indicated at 24. As shown, the abrasive surface constitutes one annular face of a disk-like member having a disk-shaped hub portion 26 which is offset axially with respect to the annular portion providing the operative face 24, the direction of axial offset being such that the disk-shaped hub portion 26 is recessed with respect to the operative face 24.

It will be understood that the abrasive wheel member 14 is formed of moldable material compositions known in the prior art. Examples are set forth in the patents previously referred to, the disclosures of which are hereby incorporated by reference into the present specification to exemplify the composition of the material embodied in the abrasive wheel member.

In order to insure a solid fixed engagement of the insert member 12 in imbedded relation within the hub portion 26 of the abrasive wheel member 14, there is formed in the annular flange section 20 of the insert member 12 a series of annularly spaced openings 28 formed by deflecting portions 30 of the annular section axially in a direction toward the end of the cylindrical section 18 opposite to the end to which the annular flange is connected. It will be noted that the projections 30 extend into the molded material of the hub portion 26 as best shown in FIG. 2 to provide for a resistance to the turning of the insert member 12 with respect to the hub portion 26. It will also be noted that the material of the hub portion contacts the exterior surface of the cylindrical section 18 and the surface of the annular flange section 20 facing in the direction of axial extent of the cylindrical section 18 from the flange section 20, leaving the opposite surfaces of both sections exposed.

The shaft engaging member 16 is a cast metallic member preferably die cast of a zinc aluminum alloy as disclosed in the aforesaid patents. The cast metallic member 16 includes a cylindrical hub connecting portion 32 having an exterior diameter slightly less than the interior diameter of the cylindrical section 18 of the sheet metal member 12, an annular hub face engaging flange portion 34 extending outwardly from one end of the cylindrical portion 32 and a central shaft connecting portion 36 extending axially from the annular flange portion 34. The shaft connecting portion 36 is provided with interior surfaces shaped to engage cooperating surfaces provided in the shaft end (not shown) and, as shown, such surfaces are preferably in the form of conventional threads 38. The exterior of the shaft connecting portion 36 is formed with surfaces shaped to be engaged by a wrench as, for example, flat surfaces 40 forming a square exterior configuration. The flange portion 34 is shaped to conform with the recessed configuration of the hub portion 26. It is important to note that there is formed in the juncture between the cylindrical portion 32 and the flange portion 34 of the member 16 tongue means adapted to mate with the groove means of the insert member 12, such tongue means being in the form of a corresponding plurality of circumferentially spaced tongues or projecting elements 42 of a triangular shape, generally corresponding to the triangular shape of the grooves.

The cast metallic member 16 is adapted to be fixed to the wheel member 14 with the sheet metal member 12 imbedded therein in an assembled position in which the cast metallic member and wheel member with the sheet metal member imbedded therein are aligned axially and moved axially together so that the cylindrical portion 32 of the cast metallic member 16 extends through the exposed interior surface of the cylindrical section 18 of the insert member 12 outwardly of the face of the hub portion 26 corresponding with the operative face 24. It will be noted that the flange portion 34 of the cast metallic member is disposed in adjacent relationship with the hub portion 26. In accordance with conventional practice, a paper washer containing safety data and other identifying information may be provided between the annular flange portion and the wheel member, such paper washer being omitted from the drawings as not essential to the assembly. It is important to note that in the assembled position the projecting tongues 42 of the die cast metallic member 16 matingly engage within the corresponding plurality of grooves 22 formed in the insert member 12.

Finally, it will be noted that the cast metallic member 16 is retained in its assembled position with respect to the wheel member 24 and imbedded insert member 12 by swaging the exterior of the cylindrical portion 32 which extends outwardly of the aforesaid hub portion face so as to deform the same annularly outwardly into a bead or rim configuration 44 which extends axially inwardly into engaged relation to the adjacent hub portion face.

It can thus be seen that there has been provided a grinding wheel assembly 10 which includes three basic components capable of economic individual fabrication and assembly. It will be noted that the provision of the grooves in the juncture between the cylindrical section 18 and the annular flange section 20 of the insert member 12 not only provides for a cooperating relationship with the tongues or projecting elements 42 of the die cast member 16 but serves to provide for a more rigid and permanent connection of the insert member 12 in imbedded relation within the hub portion 26. The effectiveness of the connection of the insert member within the hub portion is further enhanced by the provision of the integral projections 30 and openings 28 formed thereby within which the moldable material extends during the molding operation. With the insert effectively mounted within the grinding wheel member so that there can be no relative rotational movement of either of these members with respect to the other, an effective assembly which will transmit all of the rotational movement of the shaft to the grinding wheel with minimum failure is accomplished by the engagement of the tongues 42 within the grooves 22 and the securement therein by the bead 44 created by virtue of swaging action of the extremity of the cylindrical portion 32 of the member 16.

It thus will be seen that the objects of this invention have been fully and effectively accomplished. It will be realized, however, that the foregoing preferred specific embodiment has been shown and described for the purpose of illustrating the functional and structural principles of this invention and is subject to change without departure from such principles. Therefore, this invention includes all modifications encompassed within the spirit and scope of the following claims.

What is claimed is:

1. A grinding wheel assembly for attachment to a rotary shaft comprising in combination:

a sheet metal member shaped to define a cylindrical section extending radially outwardly from one end of said cylindrical section, a wheel member having at least one operative abrasive surface and a disk-shaped central hub portion for connection with a rotating shaft, said hub portion being molded of moldable material with said sheet metal member embedded therein in a position such that (1) the exterior surface of said cylindrical section and the surface of the annular flange section facing the opposite end of the cylindrical section are contacted by the moldable material of the hub portion and (2) the opposite surfaces of both sections of said sheet metal member are exposed, and a cast metallic member including a cylindrical hub connecting portion having an exterior diameter slightly less than the interior diameter of the cylindrical section of said sheet metal member, an annular hub face engaging flange portion extending outwardly from one end of said cylindrical portion and a central shaft connecting portion extending axially from said annular flange portion having interior shaft end engaging surfaces and exterior wrench engaging surfaces, said sheet metal member having groove means formed therein at the juncture between the cylindrical and annular flange sections thereof, said groove means being open in an axial direction opposed to the axial direction of extent of said cylindrical section from said annular flange section, said cast metallic member having tongue means formed in the juncture between said cylindrical portion and said annular flange portion, said tongue means being of a size and shape to engage in mating relation within said groove means, said cast metallic member and said wheel member with said sheet metal member embedded therein being aligned axially and moved axially together into an assembled position wherein (1) said cylindrical portion extends through the exposed interior surface of said cylindrical section outwardly of one face of said hub portion, (2) said flange portion is disposed in adjacent relation to the exposed surface of said annular flange section and the opposite face of said hub portion, and (3) said tongue means is engaged in mating relation within said groove means, the extremity of said cylindrical portion of said cast metallic member extending outwardly of said one hub portion face being deformed annularly outwardly into axially inwardly engaged relation to said one hub portion face to fixedly retain said cast metallic member and said wheel member with said sheet metal member embedded therein in said assembled position.

2. A grinding wheel assembly as described in claim 1 wherein said wheel member is disk-like in configuration with said hub portion being offset axially with respect to the annular portion extending radially outwardly thereof, the direction of axial offset being such that said one hub face is recessed, the deformed extremity of said cylindrical portion being disposed within the recess.

3. A grinding wheel assembly as described in claim 2 wherein said tongue means comprises a plurality of circumferentially spaced tongues and said groove means comprises a corresponding plurality of circumferentially spaced grooves.

4. A grinding wheel assembly as described in claim 3 wherein each tongue is of generally triangular configuration and each groove is of corresponding shape.

5. A grinding wheel assembly as described in claim 4 wherein said sheet metal member includes a plurality of annularly spaced openings in said annular flange section formed by deflecting portions of said annular section axially in a direction toward the opposite end of the cylindrical section thereof.

6. A grinding wheel assembly as described in claim 5 wherein the interior surfaces of the annular flange portion of said cast metallic member comprise threads.

7. A grinding wheel assembly as described in claim 1 wherein said tongue means comprises a plurality of circumferentially spaced tongues and said groove means comprises a corresponding plurality of circumferentially spaced grooves.

8. A grinding wheel assembly as described in claim 7 wherein each tongue is of generally triangular configuration and each groove is of corresponding shape.

9. A grinding wheel assembly as described in claim 1 wherein said sheet metal member includes a plurality of annularly spaced openings in said annular flange section formed by deflecting portions of said annular section axially in a direction toward the opposite end of the cylindrical section thereof.

10. A grinding wheel assembly as described in claim 1 wherein the interior surfaces of the annular flange portion of said cast metallic member comprise threads.

* * * * *